US008567781B2

(12) United States Patent
Nishida et al.

(10) Patent No.: US 8,567,781 B2
(45) Date of Patent: Oct. 29, 2013

(54) MEDIUM TRANSPORT DEVICE AND IMAGE FORMING APPARATUS

(75) Inventors: Haruhiko Nishida, Kanagawa (JP); Kouichi Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 85 days.

(21) Appl. No.: 13/362,461

(22) Filed: Jan. 31, 2012

(65) Prior Publication Data

US 2013/0084117 A1 Apr. 4, 2013

(30) Foreign Application Priority Data

Sep. 30, 2011 (JP) ..... 2011-216940

(51) Int. Cl.
*B65H 29/54* (2006.01)

(52) U.S. Cl.
USPC ..... 271/307; 271/311; 271/312

(58) Field of Classification Search
USPC ..... 271/307, 311, 312
See application file for complete search history.

(56) References Cited

U.S. PATENT DOCUMENTS

| | | | | |
|---|---|---|---|---|
| 4,028,050 | A * | 6/1977 | Bar-on | 432/59 |
| 6,782,229 | B2 * | 8/2004 | Kurisu | 399/323 |
| 7,486,922 | B2 * | 2/2009 | Nakano et al. | 399/323 |
| 2004/0178573 | A1 * | 9/2004 | Hasegawa | 271/307 |
| 2011/0142505 | A1 | 6/2011 | Konishi et al. | |

FOREIGN PATENT DOCUMENTS

JP 2011-123268 A 6/2011

* cited by examiner

*Primary Examiner* — David H Bollinger
(74) *Attorney, Agent, or Firm* — Sughrue Mion, PLLC

(57) ABSTRACT

A medium transport device includes a rotating member forming a nip region with a facing member; a guide member configured to rotate in first and second directions opposite to each other; a protrusion serving as a positioning reference for the guide member; and a restricting member including first and second surfaces. The restricting member restricts rotation of the guide member in the first direction such that the guide member does not rotate beyond a position at which the first surface is in contact with the protrusion and at which the guide member guides a sheet medium in an intended direction, and restricts rotation of the guide member in the second direction such that the guide member does not rotate beyond a position at which the second surface is in contact with the protrusion and at which the guide member is not in contact with the facing member.

7 Claims, 9 Drawing Sheets

MEDIUM TRANSPORT DEVICE AND IMAGE FORMING APPARATUS

CROSS-REFERENCE TO RELATED APPLICATIONS

This application is based on and claims priority under 35 USC 119 from Japanese Patent Application No. 2011-216940 filed Sep. 30, 2011.

BACKGROUND

Technical Field

The present invention relates to a medium transport device and an image forming apparatus.

SUMMARY

According to an aspect of the present invention, a medium transport device includes a rotating member, a guide member, a protrusion, and a restricting member. The rotating member forms a nip region with a facing member and feeds a sheet medium through the nip region by rotating. The guide member is configured to rotate in a first direction and in a second direction around an axis that is located at a predetermined position, the second direction being opposite to the first direction, the guide member guiding the sheet medium, which has been sent out from the nip region by the rotating member, in an intended direction. The protrusion serves as a positioning reference for the guide member. The restricting member is disposed on the guide member and includes first and second surfaces that come into contact with the protrusion. The restricting member restricts rotation of the guide member in the first direction such that the guide member does not rotate beyond a position at which the first surface is in contact with the protrusion and at which the guide member guides the sheet medium in the intended direction. The restricting member restricts rotation of the guide member in the second direction such that the guide member does not rotate beyond a position at which the second surface is in contact with the protrusion and at which the guide member is not in contact with the facing member.

BRIEF DESCRIPTION OF THE DRAWINGS

Exemplary embodiment(s) of the present invention will be described in detail based on the following figures, wherein.

DETAILED DESCRIPTION

Exemplary Embodiment

Figure 1:
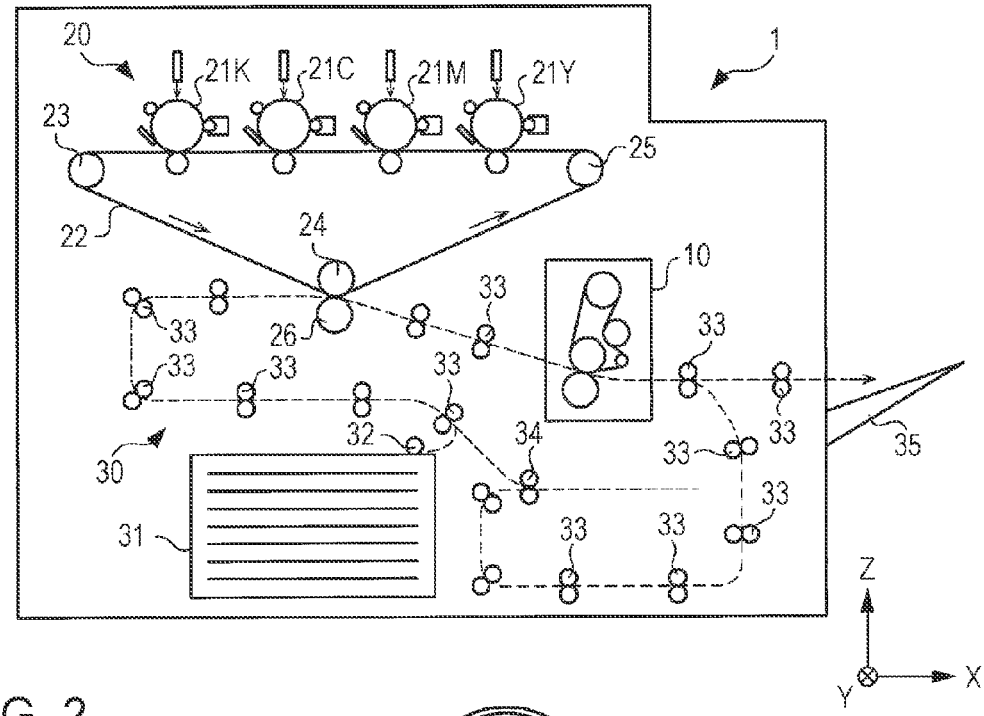
FIG. 1 illustrates the structure of an image forming apparatus.

FIG. 1 illustrates an image forming apparatus 1 according to an exemplary embodiment the present invention. The image forming apparatus 1, which is an example of an electrophotographic image forming apparatus, includes a fixing section 10 including a medium transport device according to an exemplary embodiment of the present invention. The image forming apparatus 1 includes the fixing section 10, a transfer section 20, and a transport section 30. The fixing section 10, the transfer section 20, and the transport section 30 cooperatively function as an example of an image forming unit according to the present invention. In addition to the structure illustrated in FIG. 1, the image forming apparatus 1 may include a unit for receiving image data from an external computer or the like, a unit for generating an image data by reading a document, and a unit for performing image processing on the image data.

In the following description, a three-dimensional orthogonal coordinate system illustrated in FIG. 1 will be used when necessary. The positive Z-axis direction will be referred to as "upward" and the negative Z-axis direction will be referred to as "downward". "Downward" refers to the vertically downward direction in which a gravitational force is applied to an object. The negative Y-axis direction will be referred to as "rightward" and the positive Y-axis direction will be referred to as "leftward".

The transfer section 20 transfers a toner image to a sheet. Here, the term "sheet" refers to a sheet medium (recording medium) on which an image is recorded. To be specific, the transfer section 20 includes transfer units 21Y, 21M, 21C, and 21K; an intermediate transfer belt 22; support rollers 23, 24, and 25; and a second transfer roller 26.

The transfer units 21Y, 21M, 21C, and 21K respectively form yellow (Y), magenta (M), cyan C, and black (K) toner images. Each of the transfer units 21Y, 21M, 21C, and 21K includes a photoconductor, a charger, an exposure device, and a developing unit. Each of the transfer units 21Y, 21M, 21C, and 21K forms a toner image on the photoconductor through an electrophotographic processes such as charging, exposure to light, and developing; and transfers the toner image to the intermediate transfer belt 22. This transfer will be referred to as "first transfer".

The intermediate transfer belt 22 transfers the toner images, which have been transferred from the transfer units 21Y, 21M, 21C, and 21K, to the sheet. The intermediate transfer belt 22 rotates while being supported and appropriately tensioned by the support rollers 23, 24, and 25. The intermediate transfer belt 22 transports the toner images to a position at which the second transfer roller 26 is disposed. At least one of the support rollers 23, 24, and 25, which support the intermediate transfer belt 22, is rotated by a driving force applied thereto, and rotates the intermediate transfer belt 22. The second transfer roller 26 transfers the toner images, which have been transferred (first-transferred) to the intermediate transfer belt 22, to the sheet. The second transfer roller 26 moves toner by using a potential difference generated between the second transfer roller 26 and the support roller 24, and thereby transfers the toner images to the sheet. This transfer, which is performed by the second transfer roller 26, will be referred to as "second transfer".

The transport section 30 transports the sheet. To be specific, the transport section 30 includes a containing portion 31, a pick-up roller 32, plural transport rollers 33, a reverse roller 34, and a sheet output tray 35. The containing portion 31 contains plural sheets. The pick-up roller 32 feeds a sheet contained in the containing portion 31 to a transport path at necessary timing. The transport path is illustrated by broken line in FIG. 1. The transport rollers 33 are arranged along the transport path, and transport a sheet, which has been transported from the upstream direction, in the downstream direction. Each of the transport rollers 33 includes a pair of roller members that form a nip region therebetween, and feeds a sheet in an intended direction.

The reverse roller 34 reverses the sheet transport direction and feeds the sheet when forming images on both sides of the sheet image. The reverse roller 34 temporarily receives a sheet on which a toner image has been fixed, and feeds the sheet again so that the leading end and the trailing end of the sheet are switched. An image is formed on the upper surface of the sheet when the sheet passes through the transfer section 20 and the fixing section 10. Subsequently, the sheet passes through the transport path including the reverse roller 34. As a result, the lower surface and the upper surface are switched, and toner is transferred also to a surface on which an image has not been formed. The sheet output tray 35 holds sheets on which images have been formed on one side or on both sides.

Figure 2:
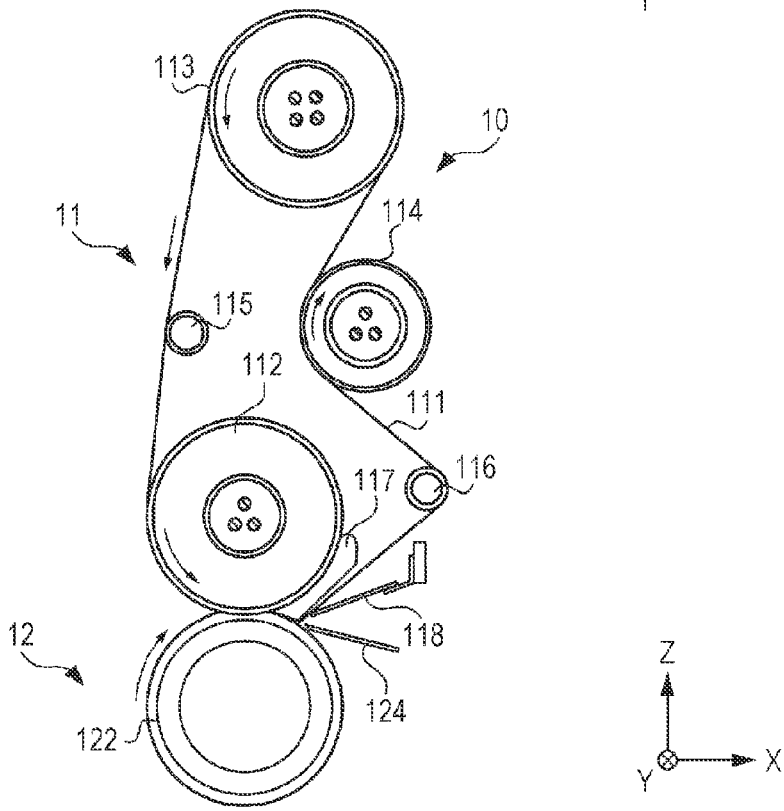
FIG. 2 illustrates the structure of a fixing section.

FIG. 2 illustrates the structure of the fixing section 10 in more detail. The fixing section 10, which fixes toner that has been transferred to the sheet, includes a heating unit 11 and a pressing unit 12. The heating unit 11 includes a mechanism for heating the sheet, and the pressing unit 12 includes a mechanism for pressing the sheet.

The heating unit 11 includes a fixing belt 111; heating rollers 112, 113, and 114; support rollers 115 and 116; a separation pad 117; and a sheet guide 118. Here, the fixing belt 111 is an example of a facing member according to the present invention. The fixing belt 111 is in contact with a pressing roller 122, forms a nip region (a region in which a sheet is nipped), heats a sheet that is interposed in the nip region, and feeds the sheet. Each of the heating rollers 112, 113, and 114 includes a heat source such as a halogen lamp and heats the fixing belt 111. The support rollers 115 and 116 apply an appropriate tension to the fixing belt 111 and support the fixing belt 111.

At least one of the heating rollers 112, 113, and 114, and the support rollers 115 and 116 is rotated by a driving force applied thereto, and moves (i.e. rotates) the fixing belt 111. Alternatively, the fixing belt 111 may be rotated by the pressing roller 122 in accordance with the rotation of the pressing roller 122. That is, at least one of the heating unit 11 and the pressing unit 12 may include a mechanism for transporting a sheet in the fixing section 10.

The separation pad 117 facilitates separation of a sheet (to be specific, heated toner on the sheet) from the fixing belt 111. The sheet guide 118 guides a sheet, which has been fed from the nip region, in the intended direction. In other words, the sheet guide 118 prevents a sheet, which has been fed from the nip region, from moving without being separated from the fixing belt 111. That is, the sheet guide 118 guides the sheet in a direction downstream in the transport direction of the sheet and downward from the position at which the sheet guide 118 is disposed.

Figure 3:
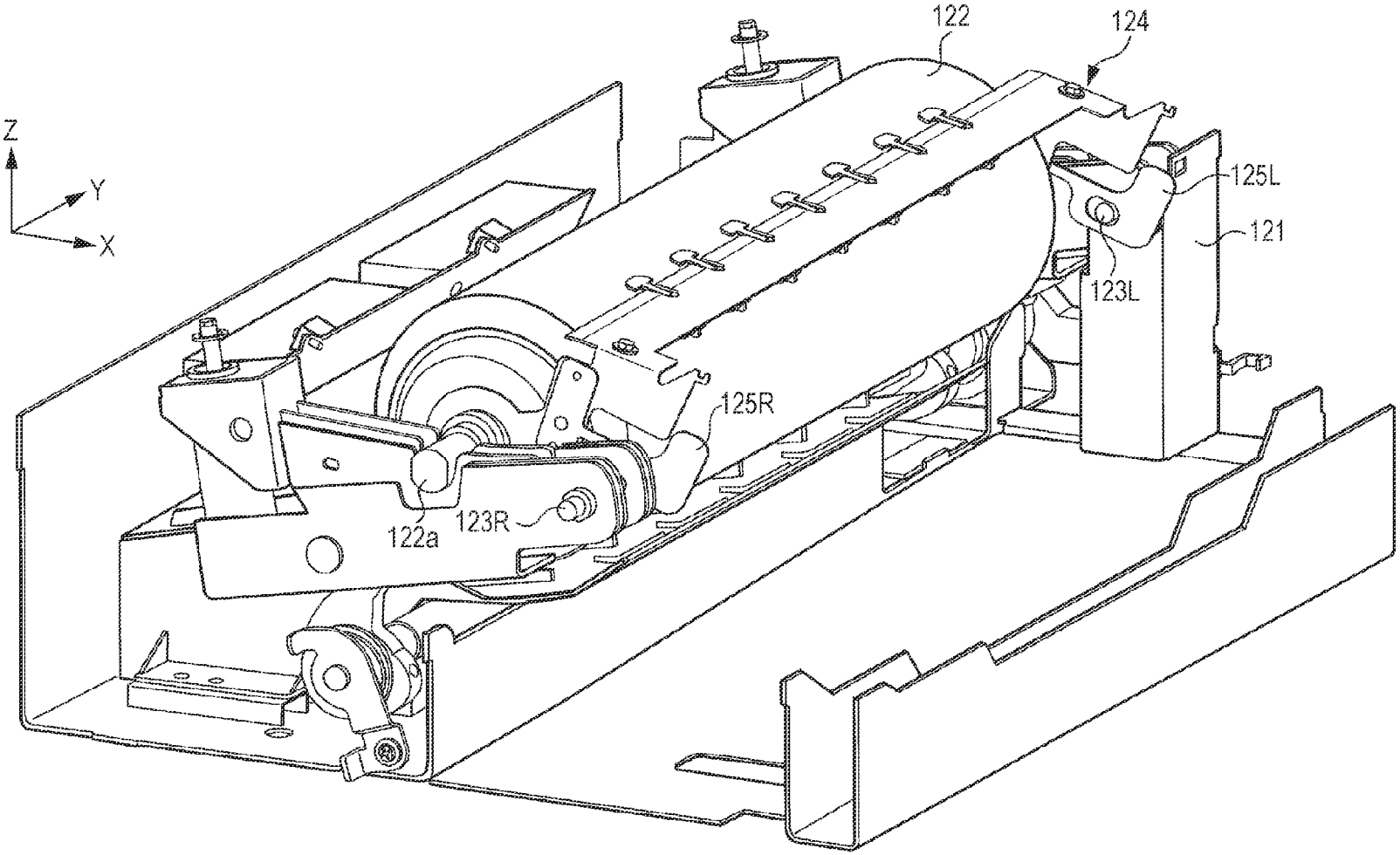
FIG. 3 is a perspective view illustrating the structure of a pressing unit.

FIG. 3 is a perspective view illustrating the structure of the pressing unit 12. The pressing unit 12 includes a housing 121, the pressing roller 122, studs 123L and 123R, a sheet guide 124, and positioning members 125L and 125R. In FIG. 3, part of the housing 121 (in particular, the right side) is not illustrated for convenience of description.

The pressing roller 122 faces the fixing belt 111, forms a nip region with the fixing belt 111, and feeds a sheet through the nip region by rotating. The pressing roller 122 rotates around a shaft 122*a* that is supported by the housing 121, and feeds a sheet while applying an appropriate pressure to the sheet. The pressing roller 122 may rotate (i.e. independently rotate) or may be rotated (i.e. rotationally driven) in accordance with the rotation of the fixing belt 111. The pressing roller 122 is an example of a rotating member according to the present invention.

The studs 123L and 123R are cylindrical protruding members that are fixed to the housing 121. The studs 123L and 123R serve as reference points for positioning the sheet guide 124. The studs 123L and 123R are configured so as not to be moved in accordance with the movements of the pressing roller 122 and the sheet guide 124. The studs 123L and 123R are examples of a protrusion according to the present invention.

The stud 123L is disposed on the left side of the pressing roller 122, and the stud 123R is disposed on the right side of the pressing roller 122. Hereinafter, the studs 123L and 123R may be collectively referred to as the "studs 123".

The sheet guide 124 guides a sheet, which has been fed from the nip region, in the intended direction. In other words, the sheet guide 124 prevents a sheet, which has been fed from the nip region, from moving without being separated from the pressing roller 122. That is, the sheet guide 124 guides the sheet in a direction downstream in the transport direction of the sheet and upward from the position at which the sheet guide 124 is disposed. The sheet guide 124 is rotatable clockwise and counterclockwise around the shaft 122*a* of the pressing roller 122. The sheet guide 124 is an example of a guide member according to the present invention.

The positioning members 125L and 125R are plate-shaped members that are disposed on both sides of the sheet guide 124 and used for positioning the sheet guide 124. The positioning members 125L and 125R are joined to the sheet guide 124 by, for example, swaging. The positioning members 125L and 125R are, for example, plate springs, and have elasticity that allows the positioning members 125L and 125R to be bent in the left-right directions by a human power. When it is necessary to remove the sheet guide 124, a user may bend the positioning members 125L and 125R inward and rotate the sheet guide 124, remove the positioning members 125L and 125R from the studs 123L and 123R, and extract the sheet guide 124.

The positioning members 125L and 125R restrict rotation of the sheet guide 124 within a predetermined range by coming into contact with the studs 123. The positioning members 125L and 125R are examples of a restricting member according to the present invention. Hereinafter, the positioning members 125L and 125R may be collectively referred to as the "positioning members 125".

Figure 4:
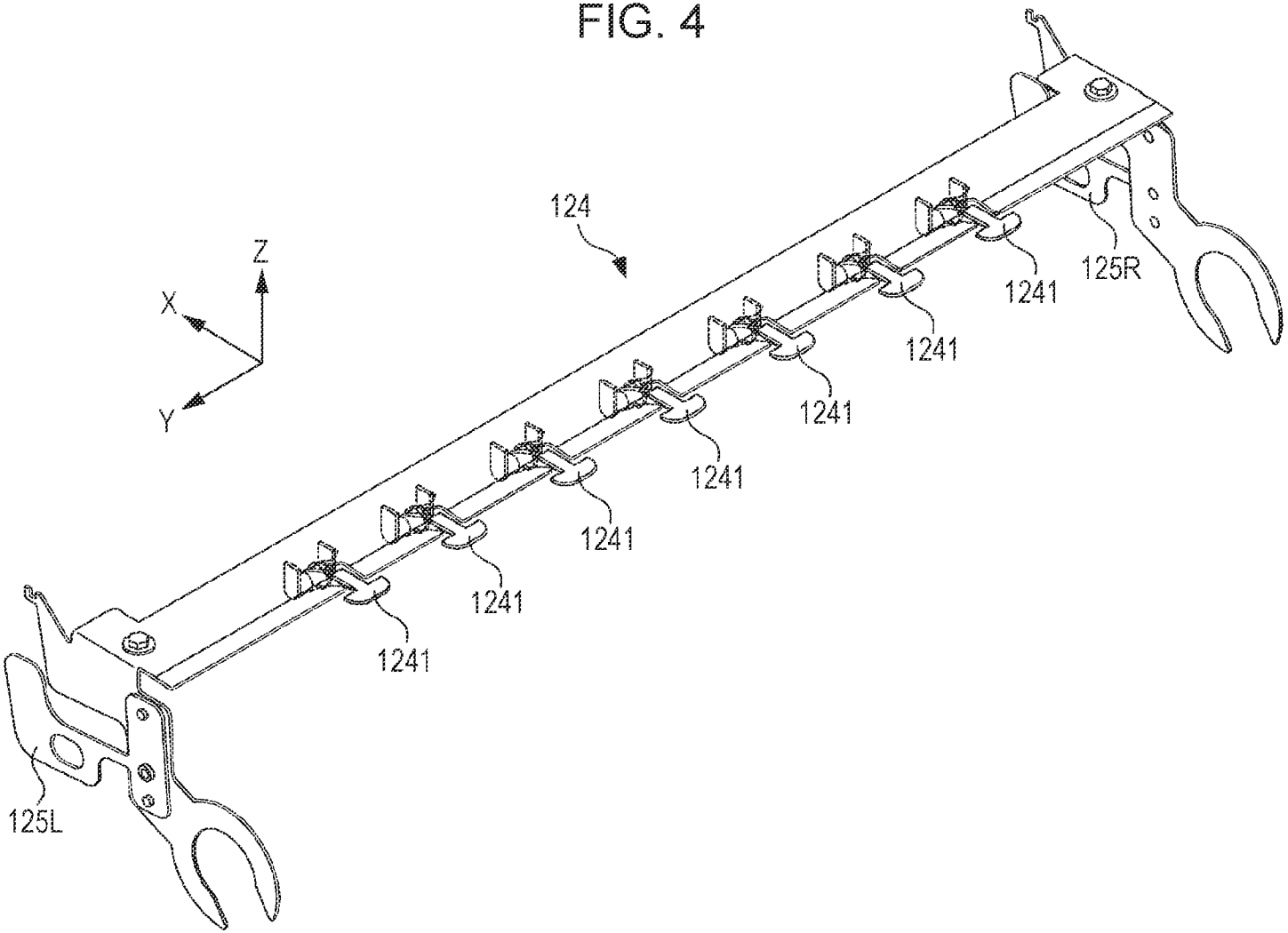
FIG. 4 is a perspective view illustrating the structure of a sheet guide.

FIG. 4 is a perspective view illustrating the structure of the sheet guide 124 seen from a direction different from that of FIG. 3. As illustrated in FIG. 4, the sheet guide 124 includes plural lug portions 1241. The lug portions 1241 are movably attached to the sheet guide 124 so that the lug portions 1241 come into contact with the pressing roller 122 with an appropriate contact pressure. The number of the lug portions 1241 is not limited to that illustrated in FIG. 4, and may be larger than or smaller than that illustrated in FIG. 4.

Figure 5:
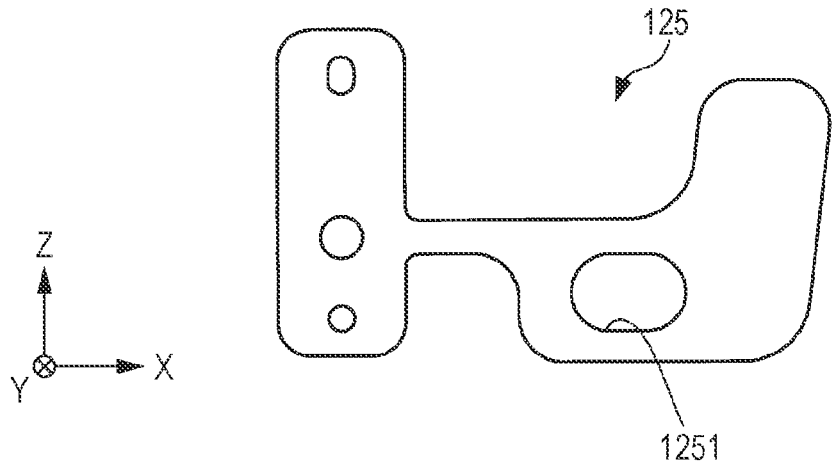
FIG. 5 illustrates the structure of a positioning member.

FIG. 5 illustrates the structure of the positioning member 125 seen from the negative Y-axis direction. The positioning member 125 has a hole 1251, and the positioning member 125 comes into contact with the stud 123 at the inner peripheral surface of the hole 1251. The size of the hole 1251 is larger than that of the stud 123. When the stud 123 is inserted into the hole 1251, the positioning member 125 (and the sheet guide 124 on which the positioning member is disposed) rotate(s) by the amount corresponding to the difference between the sizes of the hole 1251 and the stud 123.

The shapes of the positioning members 125L and 125R need not be symmetrical, as long as the positioning members 125L and 125R are capable of positioning the sheet guide 124 at a desired position.

The image forming apparatus 1 is structured as described above. With this structure, the image forming apparatus 1 transports a sheet, transfers toner to the transported sheet, and forms an image on the sheet by fixing the toner. The image forming apparatus 1 may form an image only on one side of a sheet or may form images on both sides of a sheet.

In the image forming apparatus 1, failure in transportation of a sheet, i.e. paper jam, may occur during image formation. Paper jam may occur at any position on the transport path, for example, at positions before or behind of the fixing section 10. In the nip region of the fixing section 10, paper jam may occur if a sheet is not fed in the intended direction and the sheet enters a space between the pressing roller 122 and the lug portions 1241 of the sheet guide 124. In particular, when forming images on both sides of a sheet (i.e., a sheet having an image formed on the lower surface thereof passes through the nip region), toner on the lower surface that is in contact with the pressing roller 122 may become melted again and may hinder separation of the sheet from the pressing roller 122.

Figure 6:
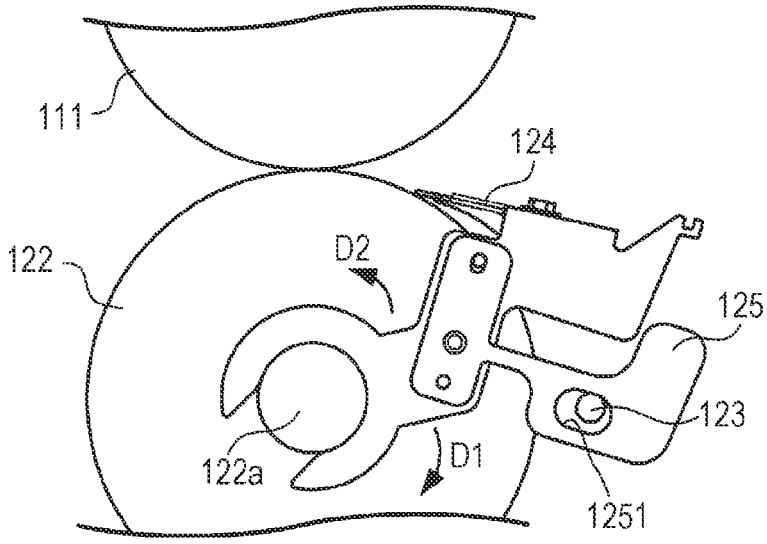
FIG. 6 illustrates an operation of the sheet guide.
Figure 7:
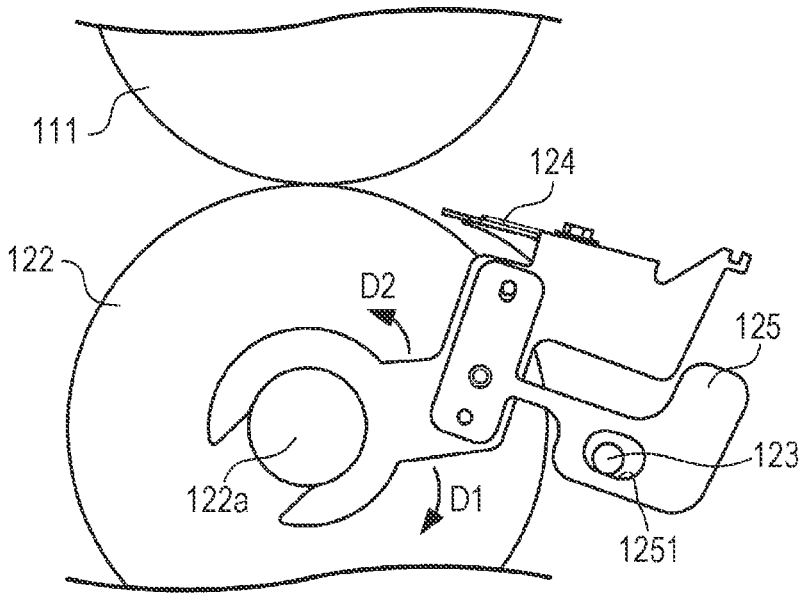
FIG. 7 illustrates an operation of the sheet guide.

FIGS. 6 and 7 illustrate operations of the sheet guide 124. FIG. 6 illustrates the position of the sheet guide 124 when the sheet is transported without causing paper jam. FIG. 7 illustrates the position of the sheet guide 124 when the sheet has become deformed (for example, bent) due to paper jam and the sheet guide 124 is lifted by the jammed sheet. The sheet guide 124 is movable between the position illustrated in FIG. 6 and the position illustrated in FIG. 7.

The positioning member 125 comes into contact with the stud 123 at the upper surface of the hole 1251, and thereby restricts rotation of the sheet guide 124 in the direction indicated by arrow D1 (i.e. clockwise direction) such that the sheet guide 124 does not rotate beyond the position illustrated in FIG. 6. When the sheet guide 124 is at this position, the lug portions 1241 come into contact with the pressing roller 122 with a desirable contact pressure, and thereby eliminate gaps between the lug portions 1241 and the pressing roller 122 and facilitate guiding of the sheet in the intended direction. In other words, the sheet guide 124 restrains the sheet from moving in a direction different from the intended direction.

Moreover, the positioning member 125 comes into contact with the stud 123 at the lower surface of the hole 1251, and thereby restricts rotation of the sheet guide 124 in the direction indicated by arrow D2 (i.e. counterclockwise direction) such that the sheet guide 124 does not rotate beyond the position illustrated in FIG. 7. At this time, the sheet guide 124 is not in contact with the fixing belt 111, which faces the pressing roller 122. In other words, the positioning member 125 restricts rotation of the sheet guide 124 such that the sheet guide 124 does not rotate beyond a position at which the sheet guide 124 fails to come into contact with the fixing belt 111.

Here, the direction indicated by arrow D1 (in this case, downward direction) corresponds to a first direction according to the present invention, and the direction indicated by arrow D2 (in this case, upward direction) corresponds to a second direction according to the present invention. The upper surface of the hole 1251, i.e. the surface that is in contact with the stud 123 in FIG. 6 corresponds to a first surface according to the present invention, and the lower surface of the hole 1251, i.e. the surface that is in contact with the stud 123 in FIG. 7 corresponds to a second surface according to the present invention.

Thus, the positioning member 125 and the hole 1251 cooperatively restrict rotation of the sheet guide 124 to a predetermined range. Because downward movement of the sheet guide 124 is restricted, the contact pressure of the sheet guide 124 against the pressing roller 122 is restrained from becoming excessively high. Because upward movement of the sheet guide 124 is restricted, the sheet guide 124 does not come into contact with the fixing belt 111 even when the sheet guide 124 is lifted by a sheet. That is, because the rotation of the sheet guide 124 is restricted, as compared to a case where the rotation is not restricted, the probability is decreased that the sheet guide 124 and members that may come into contact with the sheet guide 124 (the fixing belt 111 and the pressing roller 122) are damaged.

Modifications

An exemplary embodiment of the invention is not limited to the exemplary embodiment described above, and may be modified as described below. These modifications may be combined with each other or a part of one of the modifications may be substituted with a part of another. In the modifications described below, the components indicated by the numerals the same as those of the exemplary embodiment described above have structures and functions the same as those of the corresponding components of the exemplary embodiment.

(1) The shaft around which the guide member rotates need not be the same as the shaft of the rotating member. For example, in the exemplary embodiment described above, the sheet guide 124 rotates around the shaft 122*a* of the pressing roller 122. However, the rotation axis of the sheet guide 124 need not be the same the axis of the shaft 122*a* of the pressing roller 122.

Figure 8:
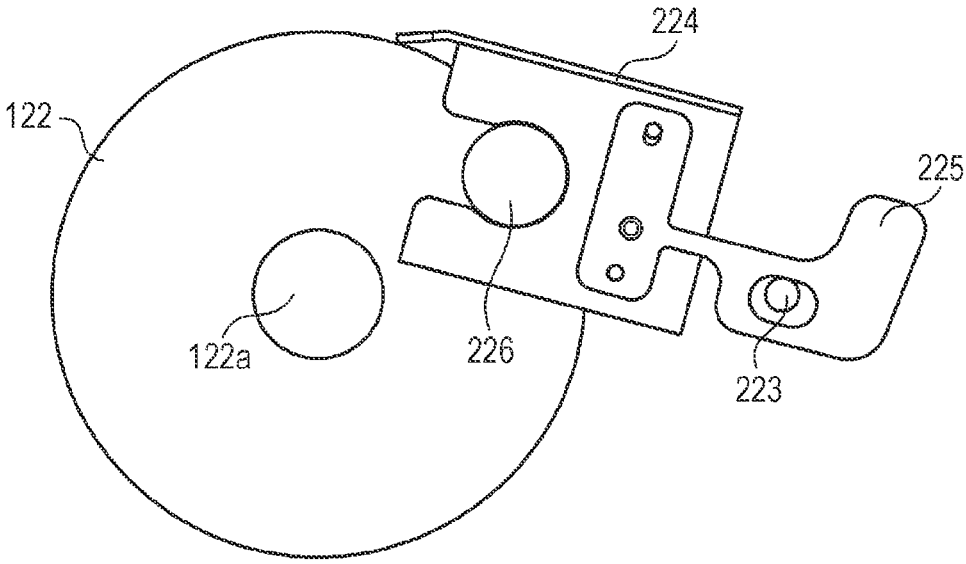
FIG. 8 illustrates another example of a sheet guide.

FIG. 8 illustrates the structure of a sheet guide 224, which is another example of a guide member according to an exemplary embodiment of the present invention. The sheet guide 224 includes positioning members 225 at the left and right ends thereof, so that rotation of the sheet guide 224 is restricted by the studs 223. The sheet guide 224 rotates around a shaft 226 that is fixed to the housing 121. The shaft 226 is, for example, formed as protrusions like the studs 223.

The function and operation of the sheet guide 224 are the same as those of the sheet guide 124 except that the rotation axis thereof is different from that of the pressing roller 122. That is, the studs 223 and the positioning member 225 cooperatively restrict rotation of the sheet guide 224 to a predetermined range. As long as the rotation range of the sheet guide 224 is restricted, the sheet glide 224 need not come into contact with the pressing roller 122.

(2) A guide member according to an exemplary embodiment of the present invention may be disposed on either one of two members that face each other and form a nip region therebetween. A rotating member according to an exemplary embodiment of the present invention is not limited to a roller and may be a belt. Likewise, a facing member may be a roller or a belt. A rotating member and a facing member according to an exemplary embodiment of the present invention need not function as a heating member.

Figure 9:
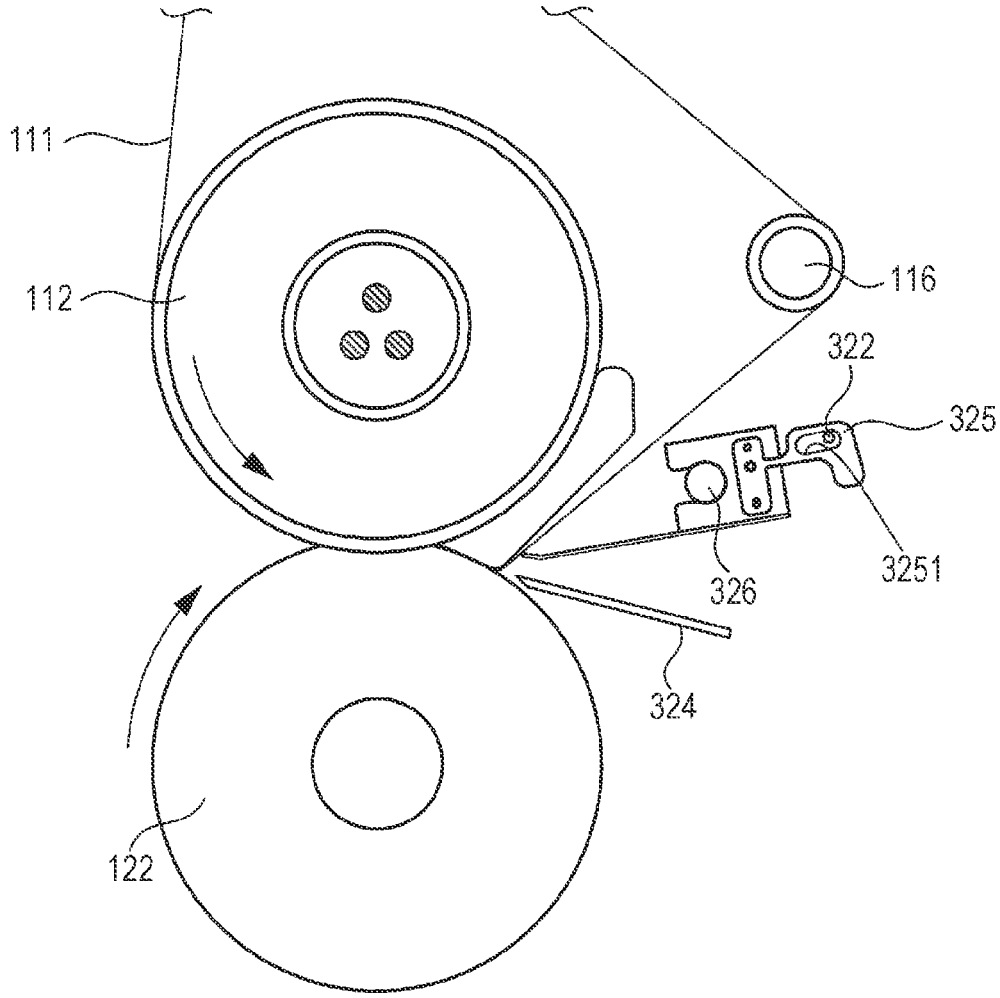
FIG. 9 illustrates another example of a sheet guide.

FIG. 9 illustrates a structure including a sheet guide 324 instead of the sheet guide 118 according to the exemplary embodiment described above. The sheet guide 324, which is an example of a guide member according to the present invention, rotates around a shaft 326. A positioning member 325 is provided to the sheet guide 324 and has a hole 3251. Because the hole 3251 of the positioning member 325 is configured to be inserted into a stud 322, the positioning member 325 restricts rotation of the sheet guide 324 to a range from a position at which the sheet guide 324 is in contact with the fixing belt 111 with an appropriate contact pressure to a position at which the sheet guide 324 does not come into contact with neither of the fixing belt 111 and the pressing roller 122.

Figure 10:
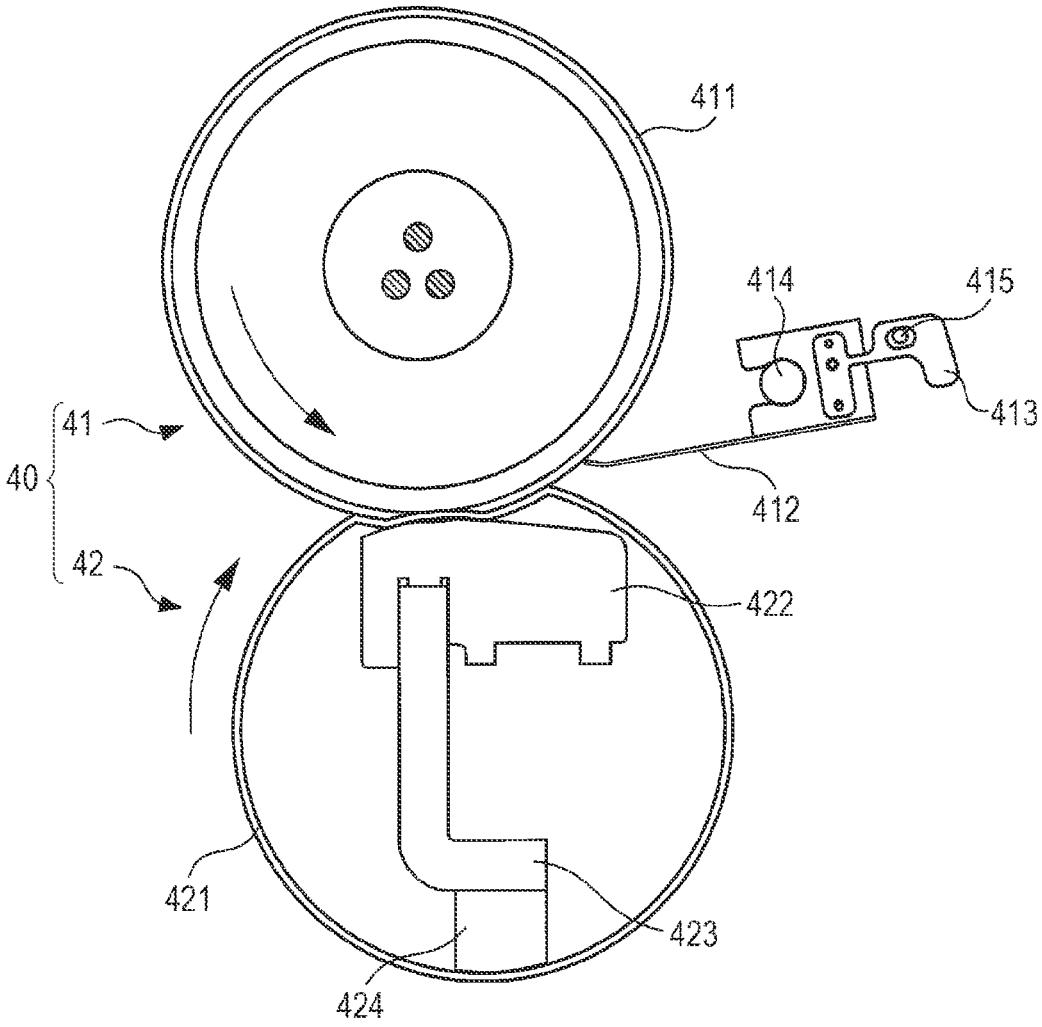
FIG. 10 illustrates another example of a fixing section.

FIG. 10 illustrates a fixing section 40 that differs from the fixing section 10. The fixing section 40 includes a heating unit 41 and a pressing unit 42. The heating unit 41 includes a heating roller 411, a sheet guide 412, a positioning member 413, a shaft 414, and a stud 415. The shaft 414 and the stud 415 are fixed to a housing of the fixing section 40. The pressing unit 42 includes a belt 421, a pad 422, a pressing member 423, and a lubrication member 424.

The belt 421 is an endless belt-shaped member that rotates in accordance with rotation of the heating roller 411 while being is in contact with the heating roller 411. The pressing member 423 is fixed, for example, to the housing of the fixing section 40, and presses the pad 422 against the heating unit 41. The pad 422 presses the belt 421 against the heating roller 411 and causes the belt 421 and the heating roller 411 to form an appropriate nip region. The lubrication member 424 is a piece of felt or sponge that is impregnated with a lubricant such as oil. The lubrication member 424 applies the lubricant to the inner peripheral surface of the belt 421 and thereby reduces friction of the belt 421 against the pad 422. The pad 422, the pressing member 423, and the lubrication member 424 do not move together with the belt 421.

The heating roller 411 faces the belt 421 and forms a nip region. The heating roller 411 contains a heat source and heats a sheet at the nip region. The sheet guide 412 functions as a guide member according to the present invention. The sheet guide 412 rotates clockwise and counterclockwise around the shaft 414, and guides a sheet that has passed through the nip region in the intended direction. The positioning member 413 functions as a restricting member according to the present invention. The positioning member 413, which has a hole 4131 formed therein, is disposed at each of the right and left ends of the sheet guide 412. The size of the hole 4131 in the positioning member 413 is smaller than that of the stud 415, so that the rotation range of the sheet guide 412 is restricted when the stud 415 is inserted into the hole 4131. The positioning member 413 restricts the rotation range of the sheet guide 412 to a range between an upper limit (limit in the upward direction) and a lower limit (limit in the downward direction). The upper limit is a position at which the sheet guide 412 is contact with the heating roller 411 with an appropriate contact pressure. The lower limit is a position at which the sheet guide 412 and the heating roller 411 are separated from each other with a predetermined distance therebetween and at which the sheet guide 412 is not in contact with the belt 421.

In the fixing section 40, the heating unit 41 need not be disposed above the pressing unit 42 as illustrated in FIG. 10. The positional relationship may be the opposite. In the fixing section 40, the heating unit 41 and the pressing unit 42 need not be arranged in the Z-axis direction (vertical direction), and may be arranged in the X-axis direction (horizontal direction). In the fixing section 40, a guide member according to the present invention (corresponding to the sheet guide 412) may be disposed on the pressing unit 42 side instead of on the heating unit 41 side. Alternatively, guide members may be disposed on both of the pressing unit 42 side and the heating unit 41 side.

(3) A guide member according to an exemplary embodiment need not be disposed in the fixing section, as long as the guide member guides a sheet medium such as a sheet of paper. The functions of the rotating member and the facing member are irrelevant to a guide member according to an exemplary embodiment of the present invention, as long as the guide member guides a fed medium in an intended direction at a position at which a nip region is formed by the rotating member and the facing member. Therefore, the guide member according to an exemplary embodiment of the present invention (and a medium transport device including the guide member) may be disposed at any position at which two members that face each other and form a nip region are disposed. For example, the guide member may be disposed in the transfer section 20 or the transport section 30 described above.

(4) In a restricting member according to an exemplary embodiment of the present invention, a first surface and a second surface need not be formed as surfaces of holes.

Figure 11:
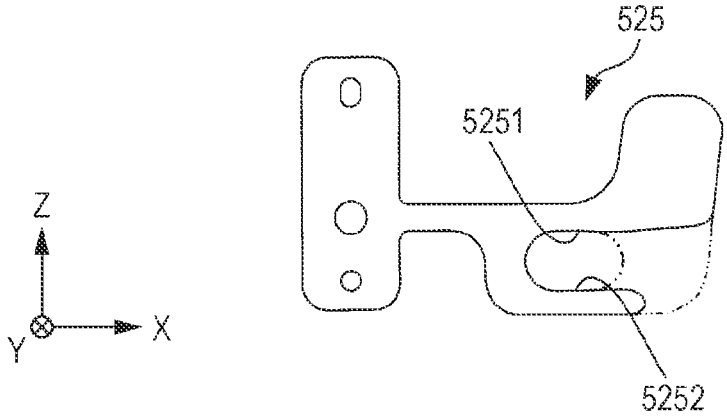
FIG. 11 illustrates another example of a positioning member.

FIG. 11 illustrates another example of a restricting member, which includes a positioning member 525 that is replaceable with the positioning member 125. The positioning member 525 differs from the positioning member 125 in that a part illustrated by two-dot chain line is not included in the positioning member 525. The positioning member 525 includes a first surface 5251 and a second surface 5252. When the positioning member 525 is attached to the sheet guide 124, the positioning member 525 comes into contact with the stud 123 at the first surface 5251 and the second surface 5252.

The strength (rigidity) against rotation of the positioning member 125 is higher than that of the positioning member 525. Therefore, when a higher strength is needed, the positioning member 125 (having the hole 1251) may be used instead of the positioning member 525.

Figure 12:
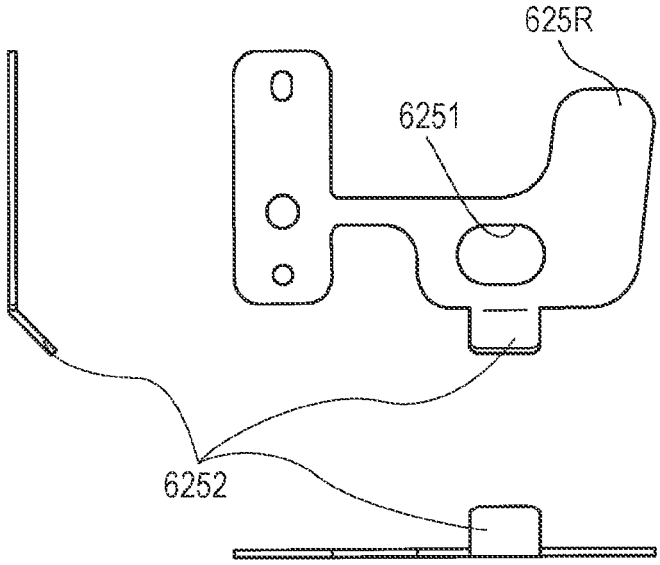
FIG. 12 illustrates another example of a positioning member.

(5) FIG. 12 illustrates another example of a restricting member, including plan view, front view, and side view of a positioning member 625R that is replaceable with the positioning member 125R. The positioning member 625R is the same as the positioning member 125R except that the positioning member 625R includes an inclined surface 6252. The inclined surface 6252 is disposed below a hole 6251, to be specific, at a position at which the stud 123R comes into contact with the positioning member 625R when the stud 123R is inserted into the hole 6251. The inclined surface 6252 facilitates warping of the positioning member 625R. The positioning member 625R is a restricting member disposed on the right side of the pressing roller 122. Another restricting member is disposed on the left side of the pressing roller 122. The restricting member is symmetric to the positioning member 625R and has a function the same as that of the positioning member 625R.

Figure 13A:
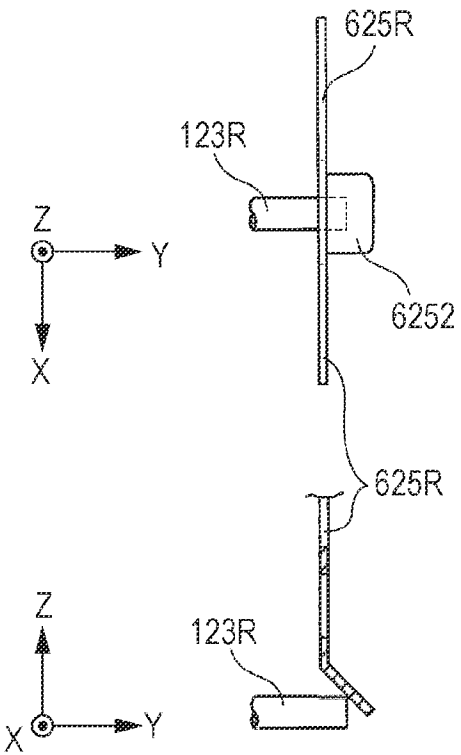
FIG. 13 illustrates successive movements of the positioning member.
Figure 13B:
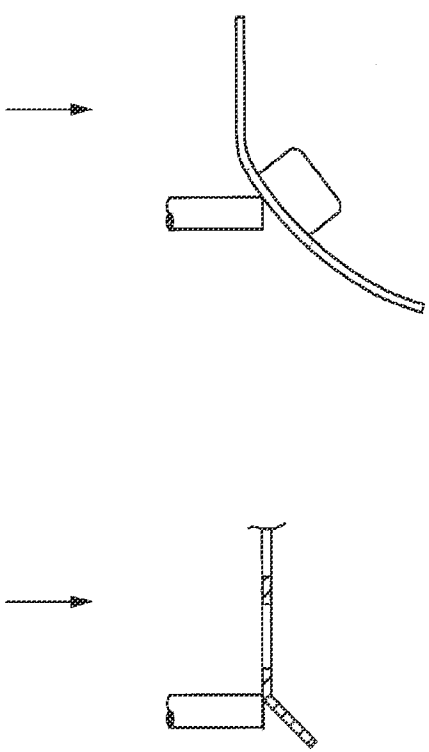
Figure 13C:
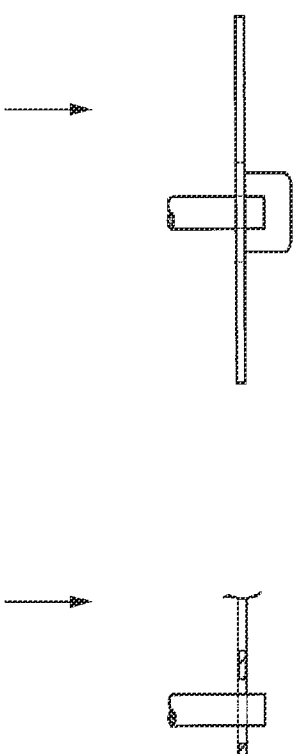

FIG. 13 illustrates successive movements of the positioning member 625R when the sheet guide 124 is attached to the positioning member 625R. When a force oriented in the downward direction (i.e. the first direction) is applied to the positioning member 625R, the positioning member 625R comes into contact with the stud 123R at the inclined surface 6252 as illustrated in FIG. 13A. When a force oriented in the downward direction is further applied and the positioning member 625R is pressed against the stud 123R, part of a rotational force in the first direction is converted to a force that warps the positioning member 625R in a direction in which the stud 123R protrudes, and the positioning member 625R become warped as illustrated in FIG. 13B. Subsequently, when a force oriented in the downward direction is further applied to the positioning member 625R and the stud 123R reaches the position of the hole 6251, the positioning member 625R recovers its original unwarped shape due to the elastic force thereof, and the positioning member 625R enters a state illustrated in FIG. 13C, i.e. a state in which the stud 123R is inserted into the hole 6251.

The force that presses the sheet guide 124 in the downward direction may be generated by an elastic member such as a coil spring. The elastic member, which supplements a force with which the sheet guide 124 is pressed against the pressing roller 122, may be provided if a sufficient contact pressure is not generated by the own weight of the sheet guide 124. However, if the elastic member is provided, operation by a user is increased because the elastic member need to be removed and attached when removing and attaching the sheet guide 124. Therefore, the elastic member may not be provided if a sufficient contact pressure is generated by the own weight of the sheet guide 124.

(6) The shape of a protrusion according to an exemplary embodiment of the present invention is not particularly limited as long as the protrusion has first and second surfaces that come into contact with the restricting member and has a function of positioning the guide member at a predetermined position. Therefore, a protrusion according to an exemplary embodiment of the present invention need not be cylindrical and may be hollow-rectangular-parallelepiped-shaped. A protrusion according to an exemplary embodiment of the present invention may have a groove in a surface thereof that comes into contact with the restricting member and may come into contact with the restricting member at the surface having the groove formed therein.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium transport device comprising:

a rotating member that forms a nip region with a facing member and feeds a sheet medium through the nip region by rotating;

a guide member that is configured to rotate in a first direction and in a second direction around an axis that is located at a predetermined position, the second direction being opposite to the first direction, the guide member guiding the sheet medium, which has been sent out from the nip region by the rotating member, in an intended direction;

a protrusion that serves as a positioning reference for the guide member; and a restricting member that is disposed on the guide member and that includes first and second surfaces that come into contact with the protrusion, the restricting member restricting rotation of the guide member in the first direction such that the guide member does not rotate beyond a position at which the first surface is in contact with the protrusion and at which the guide member guides the sheet medium in the intended direction, the restricting member restricting rotation of the guide member in the second direction such that the guide member does not rotate beyond a position at which the second surface is in contact with the protrusion and at which the guide member is not in contact with the facing member.

2. The medium transport device according to claim 1, wherein the restricting member has a hole into which the protrusion is inserted, and the first and second surfaces are included in an inner peripheral surface of the hole.

3. The medium transport device according to claim 2, wherein the restricting member includes an inclined surface that is in contact with the protrusion in a state in which the protrusion is not inserted into the hole, and that generates a warping force when a rotational force is applied to the guide member so as to press the guide member against the protrusion, the warping force being generated from the rotational force and warping the restricting member in a direction in which the protrusion protrudes.

4. An image forming apparatus comprising:

an image forming unit that transports the sheet medium by using the medium transport device according to claim 1 and forms an image on the sheet medium.

5. An image forming apparatus comprising:

an image forming unit that transports the sheet medium by using the medium transport device according to claim 2 and forms an image on the sheet medium.

6. An image forming apparatus comprising:

an image forming unit that transports the sheet medium by using the medium transport device according to claim 3 and forms an image on the sheet medium.

7. A medium transporting method comprising:

feeding a sheet medium through a nip region by rotating, the nip region being formed by a rotating member with a facing member;

guiding the sheet medium, which has been sent out from the nip region by the rotating member, in an intended direction with a guide member, the guide member being configured to rotate in a first direction and in a second direction around an axis that is located at a predetermined position, the second direction being opposite to the first direction;

positioning the guide member with a protrusion, the protrusion serving as a positioning reference for the guide member;

restricting rotation of the guide member in the first direction with a restricting member such that the guide member does not rotate beyond a position at which a first surface is in contact with the protrusion and at which the guide member guides the medium in the intended direction; and restricting rotation of the guide member in the second direction with the restricting member such that the guide member does not rotate beyond a position at which a second surface is in contact with the protrusion and at which the guide member is not in contact with the facing member, wherein the restricting member is disposed on the guide member and includes the first and second surfaces that come into contact with the protrusion.

* * * * *